United States Patent [19]

Davies

[11] 4,334,604

[45] Jun. 15, 1982

[54] COIN DETECTING APPARATUS FOR DISTINGUISHING GENUINE COINS FROM SLUGS, SPURIOUS COINS AND THE LIKE

[75] Inventor: Ronald C. Davies, Las Vegas, Nev.

[73] Assignee: Casino Investment Limited, Hong Kong

[21] Appl. No.: 21,305

[22] Filed: Mar. 15, 1979

[51] Int. Cl.[3] ..... G07F 3/02

[52] U.S. Cl. ..... 194/100 A; 73/163

[58] Field of Search ..... 194/100 A, 100 R, 102, 194/99; 73/163; 324/236, 239; 361/203

[56] References Cited

U.S. PATENT DOCUMENTS

| | | | |
|---|---|---|---|
| 2,642,974 | 6/1953 | Ogle . | |
| 3,317,016 | 5/1967 | Turillon | 194/100 R |
| 3,453,532 | 7/1969 | Gardiner | 324/236 X |
| 3,587,809 | 6/1971 | Meloni . | |
| 3,901,368 | 8/1975 | Klinger . | |
| 3,956,692 | 5/1976 | Weinberg | 194/100 R |
| 4,105,105 | 8/1978 | Braum . | |
| 4,108,296 | 8/1978 | Hayashi et al. . | |
| 4,151,904 | 5/1979 | Levasseur et al. | 194/100 A |

FOREIGN PATENT DOCUMENTS 951403 7/1974 Canada .

1254269 11/1971 United Kingdom .

OTHER PUBLICATIONS

*Electrical Fundamentals for Technicians,* 2nd edition, Robert L. Schrader, pp. 405 to 413.

*Primary Examiner*—Robert J. Spar
*Assistant Examiner*—Edward M. Wacyra
*Attorney, Agent, or Firm*—Jacobs & Jacobs

[57] ABSTRACT

A coin, spurious coin and the like is passed in close proximity with the inductance of the resonant tank circuit of an oscillator and varies the losses of the tank circuit and thereby the amplitude of a signal produced by the oscillator in accordance with the metal content of the coin, and the like. The signal produced by the oscillator is converted to a control signal having an amplitude which when in a predetermined range indicates an acceptable coin and which when outside the range indicates a rejectable spurious coin, and the like. After passing the inductance, the coin is selectively directed to an accepted location or a rejected location in accordance with the amplitude of the control signal. A passive resonant circuit is also provided in close proximity to but electrically unconnected to the resonant tank circuit for sensing the dimensions of the coin.

5 Claims, 5 Drawing Figures

COIN DETECTING APPARATUS FOR DISTINGUISHING GENUINE COINS FROM SLUGS, SPURIOUS COINS AND THE LIKE

The present invention relates to coin detecting apparatus. More particularly, the invention relates to coin detecting apparatus for distinguishing genuine coins from slugs, spurious coins, and the like, as generally disclosed in my Canadian Pat. No. 951,403 dated July 16, 1974.

In the recent past, there has been a great variety of coin-operated machines introduced to the general public. A person away from home may avail himself of a considerable number of products and services offered by coin-operated machines. Coin-operated telephones, candy and soda machines and pin ball and other game machines and record players have been utilized for at least 30 years. Even those close to home have been able to use coin-operated washing machines and dryers for many years. In the last several years, machines operated by coins have appeared for the dispensing of hot food, cold food, hot beverages, cold beverages, postage stamps, cigarettes, hygienic products, shoe shine kits, car washing services, amusement rides and devices for children and adults, and many other items and services. Parking meters have become almost universal in use. Subway turnstiles for receiving fares in coin or token form have been utilized essentially since the advent of subways.

The number of owners of coin-operated machines have thus been growing and losses engendered by people utilizing spurious coins, slugs, and the like have been growing. Most people using slugs, spurious coins, and the like, in coin-operated machines are not thieves, they merely try to "get away with it" on a small scale. Regardless of motivation, however, financial losses are great due to the use of non-genuine coins, discs, washers, punchouts, foreign coins, spurious coins, all types of slugs, and the like, in coin-operated machines. It is therefore an important necessity to protect the owners of coin-operated machines from financial loss caused by people who do not use genuine coins in such machines.

The principal object of the present invention is to provide new and improved coin detecting apparatus for accepting only genuine coins and for rejecting all non-genuine, spurious coins, and the like.

An object of the invention is to provide coin detecting apparatus which accepts genuine coins regardless of their type, size, metal content and newness and which rejects non-genuine, spurious coins and the like, regardless of their type, size and newness.

An object of the invention is to provide coin detecting apparatus which is of simple structure, operates efficiently, effectively and reliably at high speed and requires no electrical contact with coins.

Another object of the invention is to provide coin detecting apparatus which may be conveniently incorporated into coin-operated machines and the like.

Another object of the invention is to provide coin detecting apparatus which electronically rejects all non-genuine coins, and the like, regardless of whether they are ferrous or non-ferrous, thereby eliminating the need for permanent magnets or other scavenging devices.

Another object of the invention is to provide coin detecting apparatus which may be adjusted to accept or reject a wide range of coins with a single control thereby eliminating the need for presetting at least two different voltage levels.

Still another object of the invention is to provide coin detecting apparatus which is economical in production and operation.

PRIOR ART

According to applicant's best knowledge the closest prior art to the present invention is his own Canadian Pat. No. 951,403 dated July 16, 1974. Applicant is also aware of the following United States Letters Patent which generally relate to Coin Apparatus for Vending Machines: Ogle U.S. Pat. No. 2,642,974; Meloni U.S. Pat. No. 3,587,809; Klinger U.S. Pat. No. 3,901,368; Braum U.S. Pat. No. 4,105,105; Hayashi et al. U.S. Pat. No. 4,108,296; and British patent to F.A.T.M.E. U.S. Pat. No. 1,254,269.

SUMMARY OF THE INVENTION

The present invention provides a coin detecting apparatus for distinguishing genuine coins from slugs, spurious coins and the like, comprising an oscillator circuit having a resonant tank circuit including a single inductance and capacitance means for varying the amplitude of a signal produced by the oscillator circuit in accordance with the losses of the tank circuit; and coin directing means of non-magnetic material for guiding coins, slugs, spurious coins and the like to a predetermined locality, the single inductance means of the resonant tank circuit being positioned completely around the coin detecting means in close proximity with an area of the coin directing means in a manner whereby the inductance means forms an air core coil and the coins and the like pass completely through the coil from one end to the other and said losses are determined by the metal content of a coin and the like passing through the coin directing means and through the coil, the coin and the like forming the core of the coil when passing through the coil; wherein there is also provided a passive resonant circuit in close proximity to but electrically unconnected to the air core coil for sensing the dimensions of the coin, said passive resonant circuit being adapted to resonate at the frequency to which the oscillator rises when a desired coin passes through the air core coil, whereby the losses due to material content and the frequency rise due to dimensions are combined to check genuine coins as compared with spurious coins; and direction switching means in said coin directing means at said predetermined locality for selectively accepting and rejecting coins and the like in accordance with the signal produced by said resonant tank circuit and said passive resonant circuit.

DETAILED DESCRIPTION OF THE INVENTION

As before stated, the present invention constitutes an improvement on applicant's invention disclosed in his Canadian Pat. No. 951,403 dated July 16, 1974. In order to understand the invention of the present application it is deemed necessary to reproduce in part some of the disclosure of said Canadian patent. At appropriate places in the specification applicant will indicate where the disclosure of the Canadian patent ends and the present invention begins.

Applicant first generalizes the basic concept as follows:

Genuine coins introduce a precise amount of losses into the tank circuit of an oscillator circuit and non-ferrous spurious coins, such as copper, brass, aluminum, lead, etc., introduce considerably less losses into the tank circuit than genuine coins. Ferrous slugs, such as steel or iron, on the other hand, produce far greater losses in the tank circuit than genuine coins.

The operation of the apparatus of the invention is predicated on the fact that when a genuine United States coin such as for example, a quarter, is introduced into the magnetic field of, for example, an inductance coil in an oscillator tank circuit, such a coin introduces losses into the tank circuit, thereby reducing the quality factor (Q) of the tank circuit to a larger extent than most commonly used non-ferrous slugs and other spurious coins, and to a lesser extent than ferrous slugs.

Thus, when any metallic object, for example, is brought into the magnetic field of an oscillator tank circuit, the resulting losses induced in the circuit due to eddy currents and the like, reduce the amplitude of the output signal of the oscillator. A genuine coin produces losses which are greater than those produced by most non-ferrous spurious coins, and less than those produced by ferrous slugs. The reduction in amplitude of the output signal of the oscillator is greater for a genuine coin than for a non-ferrous spurious coin, and less than for a ferrous slug. This factor is used in the system of the apparatus of the invention to detect and accept only genuine coins.

In accordance with the present invention, detecting apparatus for distinguishing genuine coins from slugs, spurious coins, and the like, comprises an oscillator circuit having a resonant tank circuit including inductance and capacitance means for varying the amplitude of a signal produced by the oscillator circuit in accordance with the losses of the tank circuit. Coin directing means guides coins, slugs, spurious coins, and the like to a predetermined locality. The inductance means of the resonant tank circuit is positioned in close proximity with an area of the coin directing means in a manner whereby the losses are determined by the metal content of a coin, and the like, passing through the coin directing means. Direction switching means in the coin directing means selectively accepts and rejects coins, and the like, in accordance with the amplitude of a control signal. Control means coupled between the resonant tank circuit of the oscillator circuit and the direction switching means converts the signal produced by the oscillator circuit to a control signal for the direction switching means in a manner whereby signals produced by the oscillator circuit having an amplitude within a predetermined range control the direction switching means to accept a coin and signals produced by the oscillator circuit having an amplitude outside said range control the direction switching means to reject a spurious coin, and the like. Guide means extending from the coin directing means at the predetermined locality directs accepted coins from the direction switching means to one location and directs rejected slugs, spurious coins, and the like, from the direction switching means to another location.

The control means includes variable means for varying the amplitude range.

The direction switching means comprises a movably mounted member, a solenoid for selectively moving the member in accordance with its condition of energization and an electronic switching component connected to the solenoid and having a control electrode, and the control means is connected to the control electrode of the electronic switching component. The electronic switching component may comprise a thyristor connected to the solenoid and having a control electrode and the control means comprises a potentiometer connected to the control electrode of the thyristor for varying the amplitude range by varying the current at which the thyristor fires.

The control means further comprises excess means connected to the potentiometer for preventing the firing of the electronic switching component when the maximum amplitude of the predetermined amplitude range is exceeded by the signal produced by the oscillator circuit.

The excess means of the control means may comprise a second electronic switching component coupled to a common point in the connection between the potentiometer and the control electrode of the electronic switching component, the second electronic switching component having a control electrode, and a Zener diode connected between the control electrode of the second electronic switching component and a point having a voltage corresponding to the amplitude of a signal produced by the oscillator circuit in a manner whereby when the voltage corresponding to the amplitude of a signal produced by the oscillator circuit exceeds a magnitude corresponding to the maximum amplitude of the predetermined amplitude range the voltage breaks down the Zener diode to its conductive condition and fires the second electronic switching component thereby preventing a sufficient voltage buildup at the common point in the connection between the potentiometer and the control electrode of the electronic switching component to fire the electronic switching component.

In another embodiment of the invention, the oscillator circuit comprises a field effect transistor having a source-drain circuit and a gate terminal. The resonant tank circuit is connected in the source-drain circuit and a steady negative bias is produced at the gate terminal due to normal oscillator activity of the field effect transistor, the negative bias automatically limiting the magnitude of current flowing in the source-drain circuit.

Each of the inductance means of the resonant tank circuit and the resonant tank circuit has a quality factor and a coin, and the like, passing in close proximity with the inductance means reduces the quality factor of the inductance means thereby reducing oscillator activity and decreasing the negative bias at the gate terminal of the field effect transistor and a genuine coin passing in close proximity with the inductance means reduces the quality factor of the resonant tank circuit to an extent which substantially halts oscillation completely. The control means comprises a resistor connected in series with the source-drain circuit of the field effect transistor in a manner whereby any variation of current through the field effect transistor is indicated as a voltage drop across the resistor and a decrease in the negative bias at the gate terminal causes the field effect transistor to momentarily operate more intensely thereby creating a proportional voltage drop across the resistor, the resistor being coupled to the direction switching means.

The direction switching means comprises a movably mounted member, an accept solenoid for moving the member to an accept position in accordance with its condition of energization, a thyristor connected to the accept solenoid and transistor amplifying means coupling the resistor to the thyristor in a manner whereby when a genuine coin passes in close proximity with the inductance means of the resonant tank circuit the thyristor is fired and energizes the accept solenoid to move the member to the accept position to direct the coin to the one location via the guide means.

The direction switching means further comprises a reject solenoid for moving the member to a reject position in accordance with its condition of energization, additional transistor amplifying means connecting the resistor to the reject solenoid and potentiometer means connected to the additional transistor amplifying means for controlling the operation of the additional transistor amplifying means in a manner whereby a voltage produced across the resistor by a genuine coin passing in close proximity with the inductance means of the resonant tank circuit fails to energize the reject solenoid via the additional transistor amplifying means and whereby a spurious coin, and the like, of ferrous material passing in close proximity with the inductance means of the resonant tank circuit produces a voltage across the resistor which is greater then that produced by a genuine coin and energizes the reject solenoid to move the member to the reject position to direct the coin to the other location via the guide means.

The capacitance means of the resonant tank circuit of the oscillator circuit comprises a variable capacitor connected in parallel with the inductance means of the resonant tank circuit for varying the amplitude range.

In accordance with the invention, a method of distinguishing genuine coins from slugs, spurious coins, and the like, comprises the steps of varying the losses of the resonant tank circuit of an oscillator circuit in accordance with the metal content of a coin, slug, spurious coin, and the like, by passing a coin and the like in close proximity with the inductance thereby varying the amplitude of a signal produced by the oscillator circuit in accordance with the metal content of the coin and the like, converting the signal produced by the oscillator circuit to a control signal having an amplitude which when in a predetermined range indicates an acceptable coin and which when outside the range indicates a rejectable spurious coin, and the like, and selectively directing a coin after passing the inductance to one of an accepted location and a rejected location in accordance with the amplitude of the control signal. The amplitude range is variably determined. Again generally speaking, all of the foregoing description relates to the type of coin detecting apparatus to which the present invention relates and which is disclosed in my Canadian Pat. No. 951,403 dated July 16, 1974.

More particularly, the present invention provides in the coin detecting apparatus of the type disclosed in my Canadian Pat. No. 951,403 dated July 16, 1974, a passive resonant circuit in close proximity to but electrically unconnected to the air core coil for sensing the dimensions of the coin, said passive resonant circuit adapted to resonate at the frequency to which the oscillator rises when a desired coin passes through the air core coil, whereby the losses due to material content and the frequency rise due to dimensions are combined to check genuine coins as compared with spurious coins; and having direction switching means in said coin directing means at said predetermined locality for selectively accepting and rejecting coins and the like in accordance with the signal produced by said resonant tank circuit and said passive resonant circuit.

In order that the invention may be readily carried into effect, it will now be described with reference to the accompanying drawings, wherein.

Applicant acknowledges that FIGS. 1, 2, 3 and 4 are common to his Canadian Pat. No. 951,403 dated July 16, 1974 and form part of the prior art. FIG. 5 shows novel circuitry here sought to be patented in association with the apparatus shown in FIG. 4.

Figure 1:
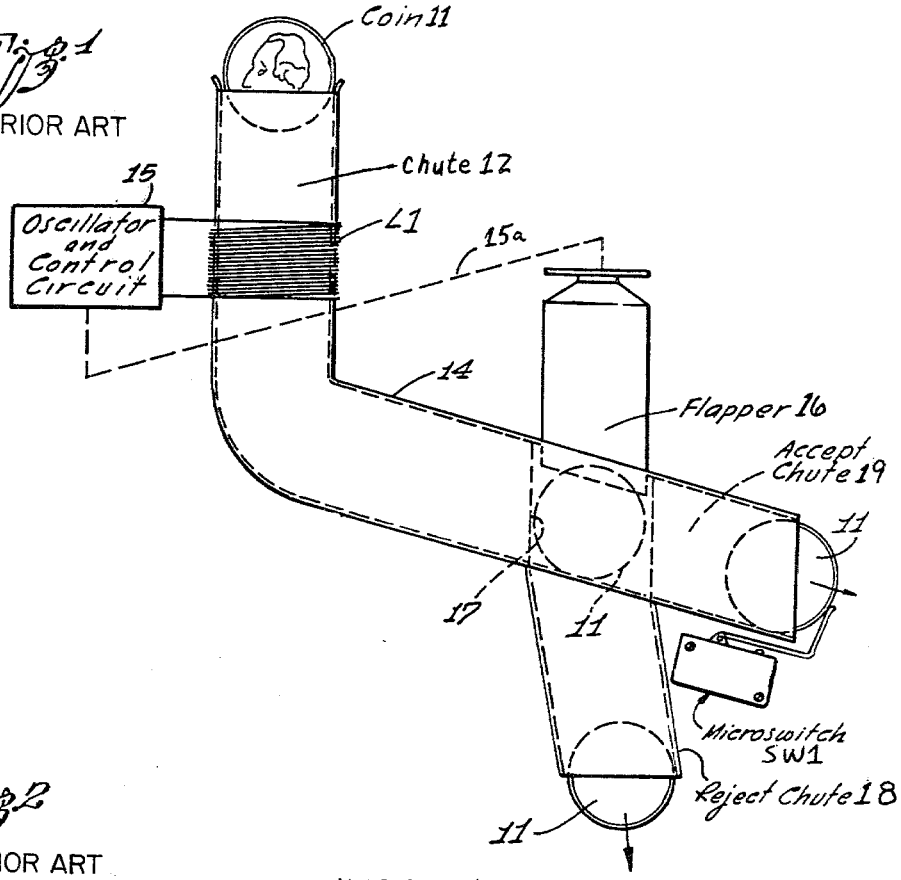
Fig. 1 PRIOR ART
FIG. 1 is a schematic side elevation of an embodiment of the basic coin detecting apparatus to which the present invention relates.

The apparatus of FIG. 1 includes a chute 12 which is preferably positioned so that its upper section is vertical and which may comprise any suitable electrically insulating material such as, for example, a suitable synthetic or plastic material such as, for example, acrylic material. The chute 12 has a rectangular cross-section so that it admits and directs a coin, spurious coin, slug, and the like, 11. The coin 11 may be introduced into the chute 12 at its upper end. The chute 12 is bent at approximately its middle at approximately 90 degrees, so that it has a substantially horizontal portion 14 having a slight downward inclination to the horizontal.

A coin, and the like, be it genuine, or non-genuine or spurious, is inserted at the top of the chute 12 and falls down through the vertical portion thereof to the horizontal portion 14 thereof, and then rolls down said horizontal portion, from the left to the right, toward the right hand end of said horizontal portion.

An opening 17 is provided in the side of the horizontal portion 14 of the chute 12, and a movable member or "flapper" 16 is movably mounted in and extends partially across the opening 17. The flapper 16 is controlled by an appropriate solenoid, described hereinafter, so that when the solenoid is energized or actuated, said flapper interposes itself between the coin 11 and the opening 17, so that the coin may continue to roll down the horizontal portion 14 of the chute 12 to the right hand end via an accept chute 19. However, if the solenoid is deenergized, the flapper 16 is not actuated by said solenoid and is removed from the opening 17, so that the coin falls through said opening into a reject chute 18. When the accepted coin rolls through the right hand end of the chute 19, it moves across and actuates the actuating arm of a microswitch SW1. The operation of the microswitch SW1 is described hereinafter in the description of the circuit of FIG. 1.

Figure 2:
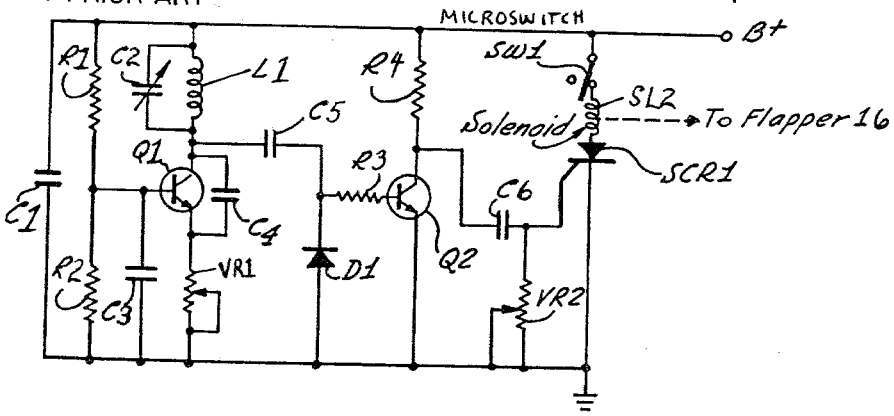
Fig. 2 PRIOR ART
FIG. 2 is a circuit diagram of an embodiment of the electrical system of the embodiment of FIG. 1 for rejecting nonferrous spurious coins.

The electrical system of the invention may comprise the circuit shown in FIG. 2, which functions to distinguish between a genuine coin and a non-genuine nonferrous coin. In each embodiment of the invention, the electrical system comprises an oscillator circuit and a control circuit. The oscillator circuit and control circuit are indicated as a block 15 in FIG. 1. The control circuit is coupled to the flapper 16, as indicated by a broken line **15*a* in FIG. 1, and said flapper functions as a direction switch, as hereinbefore described. The operation of the flapper 16** is controlled in a manner hereinafter described.

In the embodiment of FIG. 2, the oscillator circuit has a resonant tank circuit L1, C2 comprising an inductance winding L1 wound around the vertical portion of the chute 12 (FIG. 1) and a variable capacitance C2 connected in parallel. The oscillator circuit has a transistor Q1 and the resonant tank circuit is connected to the collector electrode of said transistor. The oscillator circuit is a self-oscillating RF oscillator which produces an AC output signal having a radio frequency or RF determined by the resonant tank circuit. The transistor Q1 is of NPN type, although a PNP type transistor may be utilized if the circuit connections are changed accordingly in a well known manner.

Resistors R1 and R2 are connected in series between the positive terminal of a DC voltage source B+ and a point of reference potential such as, for example, ground potential. The junction of the resistors R1 and R2 is connected to the base electrode of the transistor Q1 to provide the appropriate bias potential to said base electrode. Capacitance C1 and C3 serve as usual decoupling capacitors. The capacitor C1 is connected across the series connected resistors R1 and R2. The capacitor C3 is connected between the base electrode of the transistor Q1 and a point at ground potential. A potentiometer VR1 is connected in the emitter circuit of the transistor Q1 and adjusts the amplitude of the output signal. Feedback in the circuit to sustain oscillation is provided by a capacitor C4 connected between the collector electrode and the emitter electrode of the transistor Q1.

The output signal produced by the oscillator circuit of the transistor Q1 is coupled through a capacitor C5 to the cathode of a diode D1, where it builds up as a positive bias potential. The capacitor C5 is connected in series with the diode D1 between the collector electrode of the transistor Q1 and a point at ground potential. A resistor R3 is connected between a common point in the connection of the capacitor C5 and the diode D1 and the base electrode of a transistor Q2. The positive bias potential is applied to the base electrode of the transistor Q2 via the resistor R3. The bias potential is positive, and it normally has sufficient amplitude to render the transistor Q2, which is of NPN type, fully conductive, so that the voltage drop across a collector resistor R4 of said transistor is sufficient to render the collector potential essentially zero.

The emitter electrode of the transistor Q2 is connected to ground. The collector electrode of the transistor Q2 is coupled through a capacitor C6 to the gate or control electrode of a silicon controlled rectifier, semiconductor controlled rectifier, thyristor, or the like, SCR1. The control electrode of the controlled rectifier SCR1 is connected to a grounded potentiometer VR2 which determines the triggering threshold therefor. The anode of the silicon controlled rectifier SCR1 is connected to the positive voltage source B+ via the winding of a solenoid SL2 and the microswitch SW1 (FIG. 1) connected in series therewith. The solenoid SL2 is mechanically coupled to the flapper 16 (FIG. 1) so that said flapper is energized or actuated to cause a coin to be accepted, only if the silicon controlled rectifier SCR1 is fired.

If the controlled rectifier SCR1 is triggered or fired, it is subsequently reset by the microswitch SW1 which, as hereinbefore mentioned, is actuated by the accepted coin. The microswitch SW1 is normally closed in the anode circuit of the silicon controlled rectifier SCR1, as shown in FIG. 2, so that said controlled rectifier is extinguished or switched to its non-conductive condition and reset when said microswitch is energized, actuated or operated. The microswitch SW1 thus functions to permit the energization or operation of the circuit and to reset the circuit for the next operation.

When a coin of any type, genuine or non-genuine, passes through the chute 12, its passage through the inductance winding L1 of the resonant tank circuit L1, C2 effectively reduces the quality factor (Q) of said tank circuit and reduces the amplitude of the output signal of the oscillator. Any such reduction in amplitude of the output signal causes the potential of the collector electrode of the transistor Q2 to increase towards the B+ voltage. The positive pulse produced at the collector electrode of the transistor Q2 when a coin, spurious coin, and the like, drops through the inductance winding L1 is passed through the capacitor C6 to the gate electrode of the silicon controlled rectifier SCR1.

The firing or triggering level of the silicon controlled rectifier SCR1 is set by the potentiometer VR2. Thus, only losses beyond a particular predetermined threshold, such as are induced in the tank circuit L1, C2 by a genuine coin, produce a positive pulse at the collector electrode of the transistor Q2 of sufficient amplitude to trigger or fire the silicon controlled rectifier SCR1, and thereby energize the solenoid SL2 to actuate the flapper 16 (FIG. 1).

The losses produced by non-ferrous slugs or non-genuine or spurious coins are insufficient to energize the solenoid SL2, so that the flapper 16 is not actuated or operated. In the circuit of FIG. 2, ferrous slugs composed, for example, of iron or steel, produce greater losses in the tank circuit L1, C2 than genuine coins. Such slugs are capable of producing a pulse at the collector electrode of the transistor Q2 of sufficient amplitude to trigger the silicon controlled rectifier SCR1 and thereby energize the solenoid SL2 to actuate the flapper 16.

Since the circuit of FIG. 2 has the disadvantage of guiding ferrous spurious coins into the accept chute 19 (FIG. 1), a permanent magnet or other magnetic means may be provided to draw all ferrous slugs into the reject chute 18 (FIG. 1) and thereby cause the apparatus to reject ferrous slugs. The circuit of FIG. 3 may be utilized to overcome the disadvantage of the circuit of FIG. 2. The same oscillator circuit and part of the control circuit of FIG. 2 are utilized in FIG. 3. Thus, the capacitor C6 and the circuitry preceding it in FIG. 2 are included, though such circuitry is not shown in FIG. 3. The circuit of FIG. 3 functions to distinguish genuine coins from both ferrous and nonferrous spurious or non-genuine coins.

Figure 3:
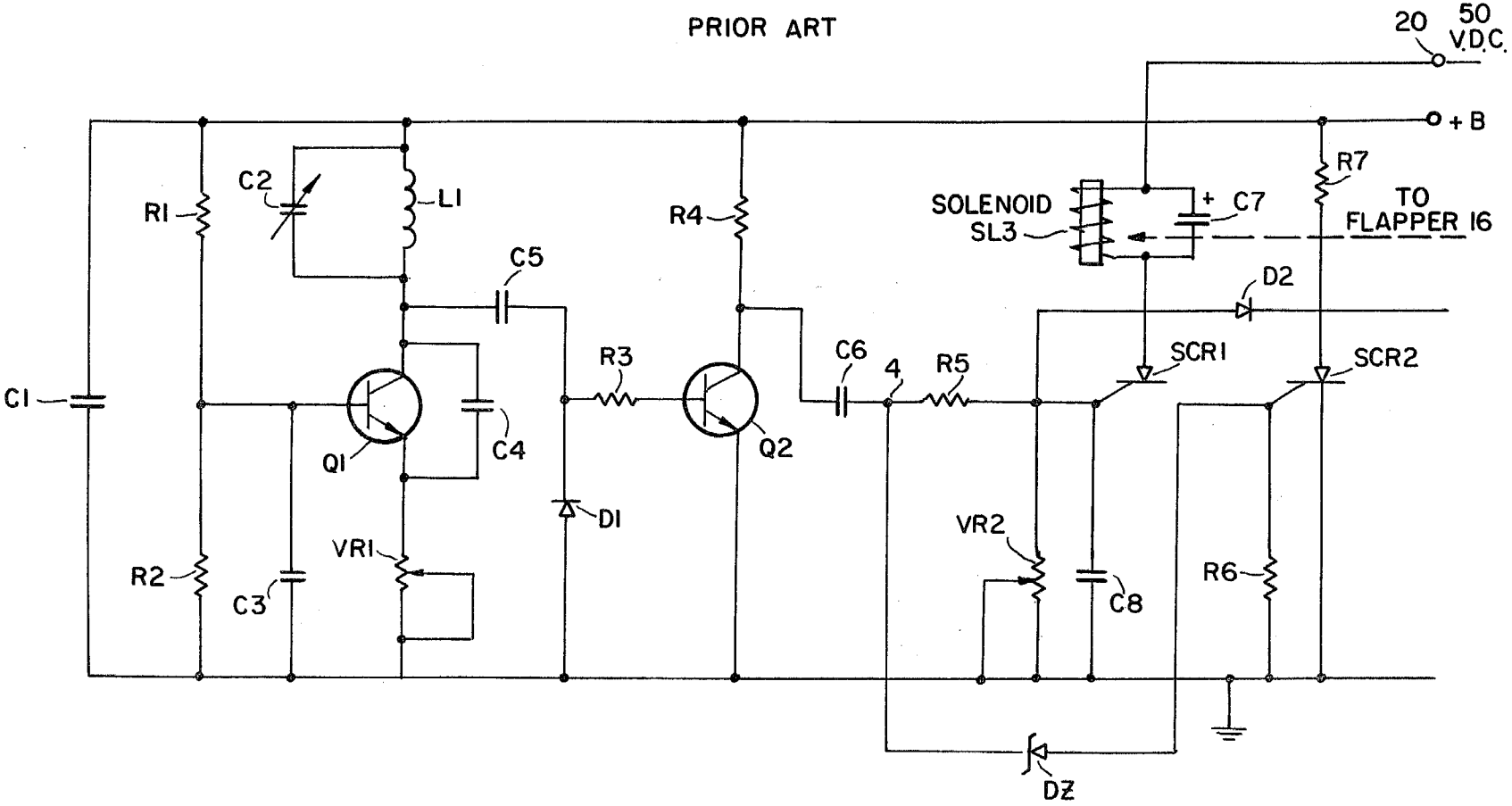
FIG. 3 PRIOR ART
FIG. 3 is a composite circuit diagram of another embodiment of the electrical system of the embodiment of FIG. 1 for rejecting ferrous and non-ferrous spurious coins.

In the circuit of FIG. 3, a solenoid SL3 is connected to an alternating current source 20 having a potential value of, for example, 50 volts. The solenoid SL3 is shunted by a capacitor C7. The shunt capacitor C7 obviates the need for the coin operated microswitch SW1 (FIGS. 1 and 2), since the alternating current itself may be used to reset the silicon controlled rectifier SCR1. This is achieved by the negative cycle of the alternating current following the reduction in the gate signal applied to the silicon controlled rectifier SCR1 below a certain threshold.

The controlled rectifier SCR1 and the potentiometer VR2 are the same as those of FIG. 2, and are connected in the same manner. The collector electrode or collector output of the transistor Q2 is coupled via the coupling capacitor C6 and a resistor R5, connected in series with said capacitor, to the gate electrode of the silicon controlled rectifier SCR1. The potentiometer VR2 is shunted by a capacitor C8. The junction of the resistor R5 and a potentiometer VR2 is coupled via a diode D2 to the anode of a second silicon controlled rectifier SCR2 and to a resistor R7. The second controlled rectifier SCR2 is connected in series with the resistor R7, with said resistor being connected to the positive terminal of the DC voltage source and the cathode of said controlled rectifier connected to a point at ground potential. The cathode of the diode D2 is connected to a common point in the connection between the resistor R7 and the controlled rectifier SCR2.

The gate electrode of the second silicon controlled rectifier SCR2 is connected to a grounded resistor R6 and is also connected back, via a Zener diode DZ, to the junction of the coupling capacitor C6 and the resistor R5. The junction of the resistor R5 and the potentiometer VR2 is designated x and the junction of the capacitor C6 and the resistor R5 is designated y.

The resistor R5 and the capacitor C8 function as a resistance capacitance or RC network which serves to delay the build-up of voltage at the point x by an amount by the time constant of the network. The Zener diode DZ has a breakdown voltage which is selected to be slightly greater than the voltage produced by a genuine coin. In a constructed embodiment of the control circuit of the apparatus of the invention, a 1.2 volt Zener diode was selected, for example. The trigger sensitivity control potentiometer VR2 is adjusted so that the silicon controlled rectifier SCR1 will fire only when pulses exceeding a predetermined threshold voltage are present in the control circuit. This voltage may be of the order of 1 volt, for example. The pulses produced by non-ferrous slugs or spurious coins fail to reach a sufficient amplitude to trigger the silicon controlled rectifier SCR1, so that non-ferrous slugs or spurious coins are rejected.

Voltages across the sensitivity control potentiometer VR2 which are produced by the passage of a genuine coin in close proximity with the inductance winding L1 are of the proper amplitude, for example, above 1 volt but below 1.2 volts, to trigger the silicon controlled rectifier SCR1 and energize the solenoid SL3, as in the embodiment of FIG. 2. When a spurious ferrous coin, slug, and the like, passes in close proximity with the inductance L1, the voltage produced across the sensitivity control potentiometer VR2 exceeds the maximum permissible limits of, for example, 1.2 volts and causes the Zener diode DZ to break down. The resulting current flow through the Zener diode DZ produces a voltage across the resistor R6 and causes the second silicon controlled rectifier SCR2 to fire. This occurs before the voltage at the point x is able to build up to an appropriate value to fire the silicon controlled rectifier SCR1.

Once the second silicon controlled rectifier SCR2 is fired, it effectively holds the gate or control electrode of the silicon controlled rectifier SCR1 at ground potential, since current flows through it and through the diode D2. The resulting excess voltage pulse produced by a ferrous spurious coin is thus incapable of firing the silicon controlled rectifier SCR1. The resistance value of the resistor R7 is such that in the absence of a gate signal there is insufficient current through the second silicon controlled recitifer SCR2 to hold said controlled rectifier in conductive condition. The circuit of the second silicon controlled rectifier SCR2 is thus self-resetting.

Figure 4:
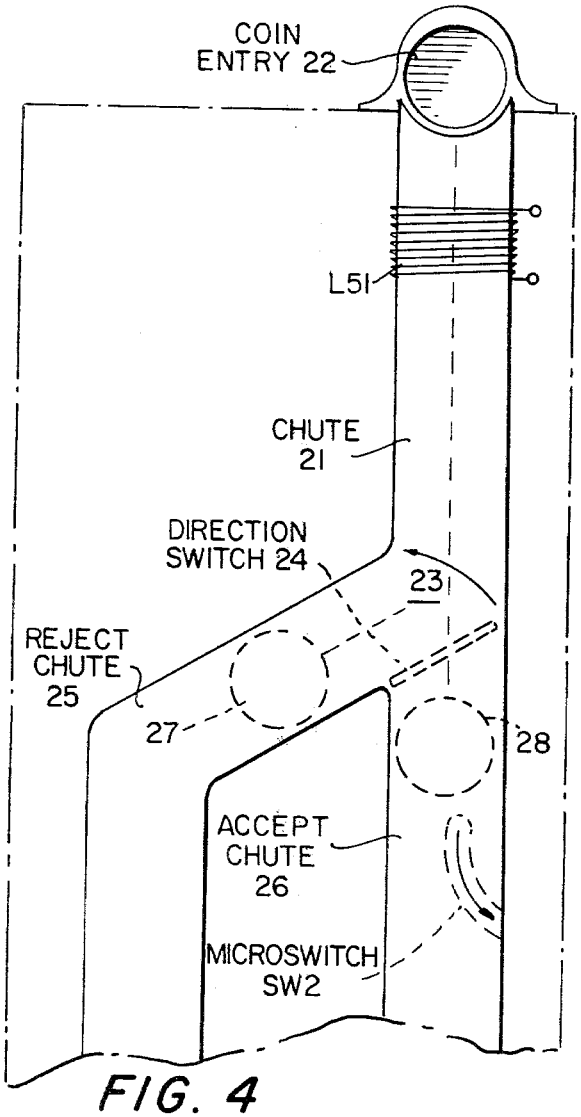
FIG. 4 PRIOR ART
FIG. 4 is a schematic side elevation of another embodiment of the coin detecting apparatus of the invention.
Figure 5:
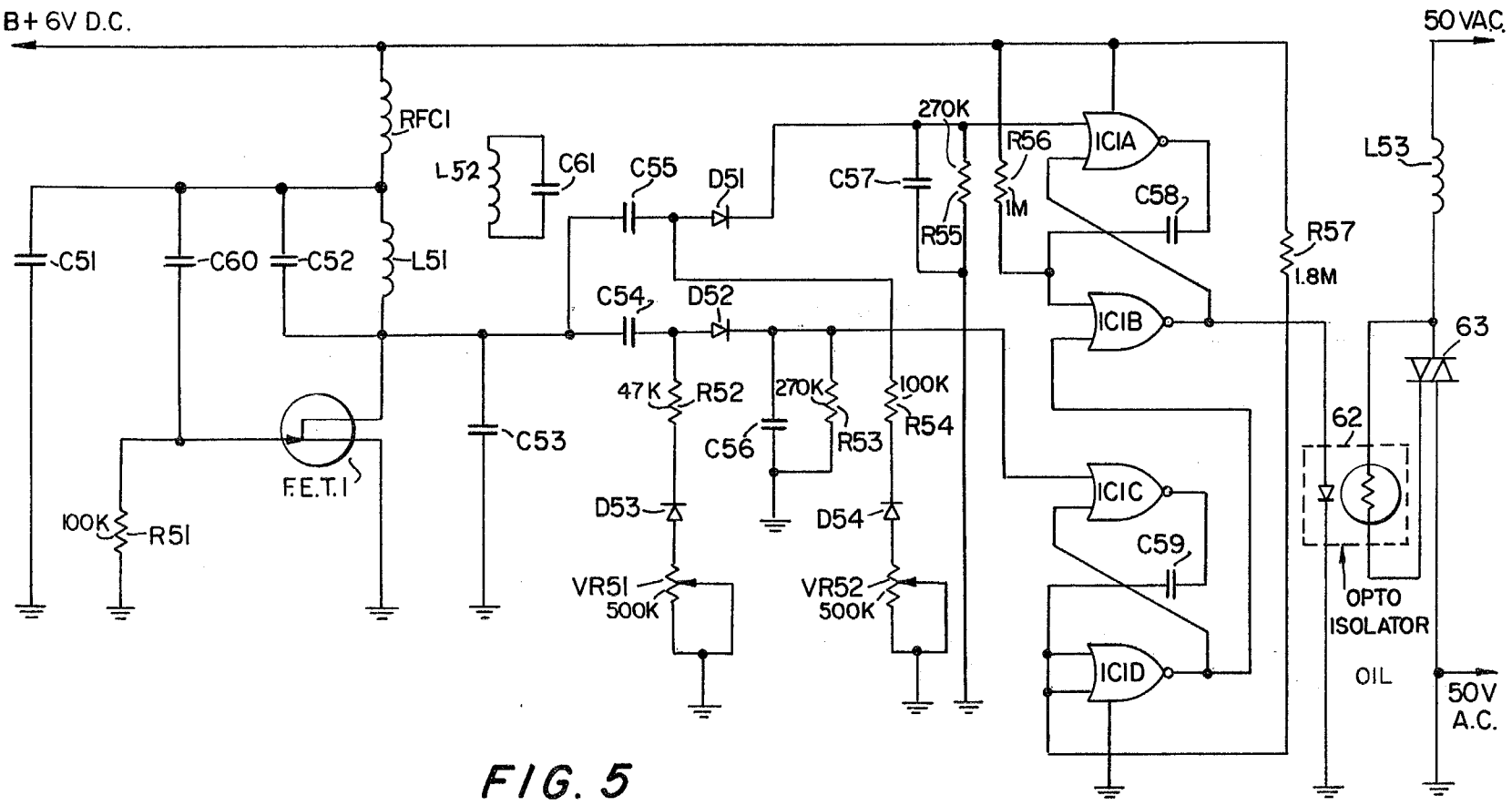
FIG. 5 is a circuit diagram of an embodiment of the electrical system of the embodiment of FIG. 4 for rejecting ferrous and non-ferrous spurious coins, and which is novel with the present application.

The embodiment of FIG. 4 is generally similar to that of FIG. 1. A chute 21 is positioned substantially vertically and comprises any suitable electrically insulting material such as, for example, a suitable synthetic material such as, for example, acrylic material. The chute 21 has a coin entry 22 at its upper end for admitting coins into said chute. The chute 21 functions as a coin director to guide coins, slugs, spurious coins, and the like, to a predetermined locality 23.

An inductance winding L51 of the resonant tank circuit of an oscillator circuit, hereinafter described, is wound around the chute 21. A coin, and the like, inserted in the coin entry 22 drops down the chute 21 through the center of the inductance winding L51 thereby producing losses therein, as hereinbefore described. A direction switch 24 comprising a movable member, controlled in position by solenoids, as hereinafter described, is movably positioned in the chute 21 in the locality 23. Under the control of solenoids, the direction switch 24 selectively accepts and rejects coins, and the like, in accordance with a control signal provided by the control circuit.

Guides extend from the chute 21 at the locality 23. The guides comprise a reject chute 25 for directing rejected spurious coins, slugs, and the like, to a reject area (not shown in the FIGS.) and an accept chute 26 for directing accepted genuine coins to an accept area (not shown in the FIGS.). When the direction switch 24 is in the position shown in FIG. 4, it directs a non-genuine or spurious coin 27 into the reject chute 25. When the direction switch 24 is in the position opposite that shown in FIG. 4, it directs a genuine coin 28 into the accept chute 26. The reject chute 25 and the accept chute 26 preferably comprise the same material as the chute 21. A microswitch SW2 is positioned in the accept chute 26 and functions as hereinafter described.

The electrical system of the embodiment of FIG. 4 of the invention may comprise the circuit shown in FIG. 5, which functions to distinguish between a genuine coin and both a ferrous and nonferrous non-genuine or spurious coin. This electrical system when combined with FIG. 4 of the drawings illustrates the invention herein sought to be patented as contrasted with the disclosure of my Canadian Pat. No. 951,403 dated July 16, 1974.

In the embodiment of FIG. 5, the oscillator circuit has a resonant tank circuit L51, C52, comprising an inductance winding L51 wound around the chute 21 (FIG. 4) and a capacitance C52 connected in parallel. The oscillator circuit has a field effect transistor FET1 which is connected as a conventional Colpitts oscillator with its resonant tank circuit L51, C52.

A field effect transistor is a known electronic component and is also called a unipolar transistor. A field effect transistor does not operate by the process of injection and therefore is not a transistor in the normal sense. It consists typically of a channel of relatively high resistivity n-type semiconductor material which is constricted in the middle by a surrounding ring of low resistivity p-type material. The ends of the channel carry ohmic contacts and the ring of p-type material, called the gate, carries a single ohmic contact. A current is set up between the ends of the channel by external means and the gate is reverse biased relative to the input source end of the channel. It is a property of a reverse biased p-n junction between low and high resistivity material, that the barrier region extends itself into the high resistivity material as the voltage is increased. In this application an increased voltage on the gate will constrict the channel more and more until, at a certain value of voltage, called the pinch-off voltage, the current through the channel is cut off. Variation of the gate voltage will modulate the channel current at voltages less than pinch-off. This device has a high input impedance compared to an ordinary transistor. Its characteristics resemble those of a vacuum tube pentode. Its frequency range is less than that of a good drift transistor.

A capacitor C60 and a resistor R51 are connected in series between the positive polarity terminal of a DC voltage source B+ and its negative polarity terminal or a point at ground potential The gate electrode of the field effect transistor FET1 is connected to a common point in the connection between the capacitor C60 and the resistor R51. The tank circuit L51, C52 is connected in the source-drain circuit of the field effect transistor FET1 to the drain electrode. The drain electrode of the field effect transistor FET1 is coupled to a point at ground potential via a capacitor C53. A capacitor C51 is connected in shunt across the series connection of the field effect transistor FET1 and the resonant tank circuit L51, C52.

Due to the normal oscillator activity of the field effect transistor FET1, a steady negative bias is developed at its gate terminal. The negative bias automatically limits the amount or magnitude of current flowing in the source-drain circuit of the field effect transistor FET1. An RF choke RFC1, is connected between the resonant circuit L51, C52, and the positive polarity terminal of the DC voltage source B+. Any variation of current through said field effect transistor is reflected as a voltage drop.

When a genuine or non-genuine coin, spurious coin, slug, and the like, is dropped in the coin entry 22 (FIG. 4) and passes through the inductance winding L52 of the resonant circuit, it reduces the quality factor Q of said inductance winding, thereby increasing the losses of said inductance winding and reducing its efficiency and thereby reducing oscillator activity. The reduction in oscillator activity decreases the negative bias of the field effect transistor FET1 and thereby causes the field effect transistor to momentarily operate more intensely.

A fixed capacitor across the sensing coil is being used in order to facilitate manufacture, avoiding the need for critical R.F. alignment procedures. The fixed capacitor C52 is selected to introduce the correct amount of Q damping for the particular coin for which the circuit is to be used. The values shown on FIG. 5 are for use with the current EISENHOWER sandwich dollar coin. Silver mica capacitors C51, C52, C53 are selected to increase the temperature and frequency stability of the circuit. Component values are selected to allow the circuit to oscillate close to MHz, typically 880 KHz. At frequencies substantially lower than 1 MHz, e.g., 500 KHz losses due to ferrous material become predominant and losses due to nonferrous material tend to fall off. At frequencies substantially higher than 1 MHz, e.g., 1–5 MHz losses due to ferrous material fall off and losses due to nonferrous material tend to rise. The frequency at which this effect begins to occur is 1 MHz. A working frequency close to this crossover point is therefore essential for adequate discrimination of all materials.

Another novel feature of this circuit of FIG. 5 is that because of the selected ratios of C52 capacitance and L51 inductance together with the construction of L51 (50 turns of 28 A.W.G. close wound in double layer form) a FREQUENCY RISE can be guaranteed for ANY conductive material which passes through L51. To further describe this effect, adding a core (coin or slug) to an inductor would ordinarily increase its inductance and thereby lower its resonance causing a DROP in frequency. Due to conditions mentioned earlier, in addition to the working frequency selected, a coin or slug passing through L51 acts as shorted turns to the inductor thereby reducing its inductance causing a corresponding RISE in frequency. This effect is quite independent of and yet concurrent with the Q losses effect described above. The effect is also much more dependent on coin dimensions than material content.

To utilize this effect in conjunction with the Q losses effect, a passive resonant circuit L52 and C61 is placed in close proximity, although not electrically connected to the coin sensing coil L51. This circuit is adjusted to resonate at the frequency to which the oscillator will rise when the desired coin passes through the sensing coil. When this frequency is reached, L52 and C61 absorb energy from the oscillator causing a reduction in oscillation amplitude which enhances the amplitude reduction caused by the Q losses. As the Q losses are mainly due to material content and the frequency rise is mainly dependent on dimensions, combining both effects in this manner provides a very simple and effective means of checking both dimensions and material content simultaneously.

The trigger circuits operate in the following manner: C55, D51, R54, D54, VR52, C57 and R55 form a diode pump circuit which serves to rectify a positive DC voltage on pin 1 of 1C1A. This DC voltage is entirely dependent on oscillation activity, any reduction in amplitude of the oscillator produces a correspond reduction of DC at 1C1A pin 1. A variable resistor VR52 is connected in the discharge path of the diode pump circuit thereby affecting its efficiency and allowing the DC voltage produced at 1C1A pin 1 to be variable.

C54, R52, D53, VR51, D52, C56, and R53 form a similar diode pump circuit producing an independently adjustable DC voltage at pin 8 of 1C1C. Component values of this circuit are selected to produce a slightly higher voltage on pin 8 to that produced at pin 1.

1C1, A,B,C and D is a CMOS single package Quad 2 input NOR gate (Motorola type MC14001B).

Sections A and B of 1C1 are connected together to form a 100 millisecond one-shot pulse generator in the following manner:

It is characteristic of CMOS logic gates to change output states when the correct input conditions reach a level which is approximately 50% of the supply voltage. Advantage of this characteristic is taken to combine a very accurate voltage level detector into the one-shot circuit. The positive DC level on pin 1 of 1C1 is set by means of VR52 to a point above its turn on level typically 3.8 V. The DC level on pin 8 of 1C1 is set by VR51 to a slightly higher level than pin 1, typically 4.2 V.

Under these conditions, pin 1 is effectively high, making pin 3 low at this time, this low is blocked from pin 5 by C58. Pin 5 is held high by R56 ensuring pin 4 to be LOW.

The same set of conditions exist for sections C and D of 1C1 which is set up as a similar one shot/level detector circuit, with a slightly longer timing period, typically 150 msec.

Pin 8 is effectively HIGH (4.2 V) making pin 10 LOW, this low is blocked from pins 12 and 13 by C59. R57 holds pins 12 and 13 HIGH ensuring pin 11 LOW.

When a legitimate coin is passed through L51, the oscillator output drops causing the diode pump circuits to produce less DC. The voltage on pin 1 of 1C1A falls to approximately 2.9 V, as previously mentioned a CMOS gate will interpret this as a LOW when working from a 6 V supply. The voltage on pin 8 of 1C1C will drop in the same proportion at this time, reaching a new value of 3.3 V as this is still higher than 50% of the supply voltage, pin 8 remains effectively HIGH so no output changes occur in the C or D sections of IC1.

The instant pin 1 goes LOW, pin 3 will go HIGH because at this time both inputs will be LOW. As pin 3 goes HIGH, it cannot affect pin 5 via C58 as pin 5 is already HIGH via R56. As the coin passes out of L51 and oscillation is returned to normal, voltage on pin 1 of IC1 returns to its effectively HIGH state, driving its output (pin 3) to its original LOW state. This LOW is coupled through C58 to pin 5 which it will hold LOW for the duration of C58's charging time (100 ms.). During this time pin 4 will go HIGH.

OI1 is an opto-isolator 62 (VACTEC TYPE VTC-5C1) consisting of a light emitting diode (L.E.D.), optically coupled to a photo-resistive cell. When the L.E.D. is energized, it illuminates the photocell and lowers its resistance.

When pin 4 of IC1B goes HIGH for the 100 msec period it activates the opto-isolator for the same time. The photocell section of the opto-isolator is connected to the gate circuit of the TRIAC 63 so that when the photocell's resistance drops, 50 V AC is switched to the accept solonoid L53.

The 100 msec timing cycle is required to allow time for the coin to fall from the area of the sensing coil L51 and pass through the accept channel of the acceptor.

If a slug of copper, brass or other nonferrous materials is dropped through L51, the voltage drop at pin 1 of IC1 would not be great enough to trigger the one shot. In this case the accept solonoid L53 would remain de-energized and block the passage of the slug to the accept channel of the acceptor.

If a ferrous slug giving a higher voltage drop were inserted through L51, IC1 sections A and B would one-shot as if it were a genuine coin, however, pin 4 would be prevented from going HIGH by the application of an inhibit HIGH on pin 6. This inhibit signal is derived from 1C1 sections C–D which operate in the precise same manner as the accept one-shot circuit, except it requires a larger voltage drop to trigger it.

The above circuits form a very efficient voltage window, allowing only pulses of an acceptable amplitude to be accepted.

The apparatus of the invention thus accepts only genuine coins and rejects all non-genuine, spurious coins, and the like, regardless of the type, size, metal content and newness of the genuine coins and the type, size and newness of the spurious coins. The apparatus of the invention rejects both ferrous and non-ferrous spurious coins, and the like, thereby eliminating the need for permanent magnets or other scavenging devices. The apparatus of the invention is of simple structure, operates efficiently, effectively and reliably at high speed and requires no electrical contact with coins. It is very simple and economical to construct, may be conveniently incorporated into coin-operated machines, and the like, and accepts only genuine coins without impairing, impeding or slowing the operation of equipment in which it is installed. The apparatus of the invention accepts genuine coins only, regardless of their worn condition and rejects all coins, and the like, which include materials which produce losses in the resonant tank circuit of the oscillator which are different from the losses produced in said tank circuit by genuine coins. It accepts or rejects a wide range of coins with a single control, and in one embodiment, utilizes a field effect transistor in the oscillator circuit for very great sensitivity.

While the invention has been described by means of specific examples and in specific embodiments, I do not wish to be limited thereto, for obvious modifications will occur to those skilled in the art without departing from the spirit and scope of the invention.

What is claimed:

1. A coin detecting apparatus for distinguishing genuine coins from slugs, spurious coins and the like, comprising an oscillator circuit having a resonant tank circuit including a single inductance and capacitance means for varying the amplitude of a signal produced by the oscillator circuit in accordance with the losses of the tank circuit; and coin directing means of non-magnetic material for guiding coins, slugs, spurious coins and the like to a predetermined locality, the single inductance means of the resonant tank circuit being positioned completely around the coin directing means in close proximity with an area of the coin directing means in a manner whereby the inductance means forms an air core coil and the coins and the like pass completely through the coil from one end to the other and said losses are determined by the metal content of a coin and the like passing through the coin directing means and through the coil, the coin and the like forming the core of the coil when passing through the coil; characterized in that there is also provided a passive resonant circuit in close proximity to but electrically unconnected to the air core coil for sensing the dimensions of the coin, said passive resonant circuit being adapted to resonate at the frequency to which the oscillator rises when a desired coin passes through the air core coil, whereby the losses due to material content and the frequency rise due to dimensions are combined to check genuine coins as compared with spurious coins; and direction switching means in said coin directing means at said predetermined locality for selectively accepting and rejecting coins and the like in accordance with the signal produced by said resonant tank circuit and said passive resonant circuit.

2. A coin detecting apparatus according to claim 1, wherein said passive resonant circuit enhances the losses effect of the resonant tank circuit.

3. Coin detecting apparatus as claimed in claim 1, also having control means including variable means for varying the amplitude range.

4. Coin detecting apparatus as claimed in claim 1, wherein the direction switching means comprises a movably mounted member, a solenoid for selectively moving said member in accordance with its condition of energization and an electronic switching component connected to said solenoid and having a control electrode and control means connected to such control electrode of the electronic switching component.

5. Coin detecting apparatus as claimed in claim 1, wherein the oscillator circuit comprises a field effect transistor having a source-drain circuit and a gate terminal, the resonant tank circuit being connected in said source-drain circuit and a steady negative bias being produced at the gate terminal due to normal oscillator activity of the field effect transistor, said negative bias automatically limiting the magnitude of current flowing in said source-drain circuit.

* * * * *